US012628866B2

(12) United States Patent
Karnehm

(10) Patent No.: US 12,628,866 B2
(45) Date of Patent: May 19, 2026

(54) SYSTEMS AND METHODS FOR CLEANING A PIPE

(71) Applicant: Eric Lee Karnehm, Beech Grove, IN (US)

(72) Inventor: Eric Lee Karnehm, Beech Grove, IN (US)

( * ) Notice: Subject to any disclaimer, the term of this patent is extended or adjusted under 35 U.S.C. 154(b) by 51 days.

(21) Appl. No.: 18/645,994

(22) Filed: Apr. 25, 2024

(65) Prior Publication Data

US 2024/0365855 A1 Nov. 7, 2024

Related U.S. Application Data

(60) Provisional application No. 63/463,705, filed on May 3, 2023.

(51) Int. Cl.
*A24F 9/12* (2006.01)
*A24F 9/14* (2006.01)

(52) U.S. Cl.
CPC . *A24F 9/12* (2013.01); *A24F 9/14* (2013.01)

(58) Field of Classification Search
CPC ..... A24F 9/12; A24F 9/14
See application file for complete search history.

(56) References Cited

U.S. PATENT DOCUMENTS 2,049,196 A * 7/1936 Croft ..... A24F 9/12 131/244
2,252,175 A * 8/1941 Gordon ..... A24F 9/10 15/311
2,666,438 A * 1/1954 Pira ..... A24F 9/12 15/302
4,381,016 A * 4/1983 Douglas ..... B08B 9/027 134/171
2015/0096590 A1* 4/2015 Ni ..... C23C 14/564 15/93.1
2018/0279671 A1* 10/2018 Lake ..... A24F 3/02
2024/0365855 A1* 11/2024 Karnehm ..... A24F 9/14

* cited by examiner

*Primary Examiner* — Sharidan Carrillo
(74) *Attorney, Agent, or Firm* — Woodard Emhardt Henry Reeves & Wagner LLP

(57) ABSTRACT

The present disclosure provides systems and methods for cleaning of a pipe. In particular the present disclosure provides systems and methods for cleaning cannabis resin from a pipe. Devices of the present disclosure comprise a basket for receipt of a pipe, the basket positionable within a cleaning lumen. Wherein a cleaning fluid is propelled through the inner lumen of the device.

4 Claims, 11 Drawing Sheets

SYSTEMS AND METHODS FOR CLEANING A PIPE

CROSS-REFERENCE TO RELATED APPLICATION

This application claims the benefit of U.S. Provisional Application Ser. No. 63/463,705 filed May 3, 2023, which is hereby incorporated by reference.

BACKGROUND

Resin buildup is a common problem for glass pipes that are used for smoking. Resin is a sticky residue that is created when smoke condenses and sticks to the inner surface of the pipe. Over time, the buildup of resin can clog the pipe, making it difficult to use and reducing its efficiency. There are several reasons why resin buildup occurs on glass pipes. One is the type of material that is being smoked. Some materials, such as cannabis, produce more resin than others.

One common method used for cleaning resin buildup is to immerse the pipe in a solution of isopropyl alcohol or vinegar and coarse salt. The alcohol or vinegar breaks down the resin, while the salt acts as an abrasive to scrub away the buildup. This process is generally carried out in a plastic bag or plastic container. The disadvantages of such a process include problems associated with a permeable or weak bag membrane and seal, as environmental concern in use of disposable plastic bags or containers. Such prior systems are also time consuming, as the pipe is left submersed in the solution and not actively cleaned. Additionally, the conformable surface of a plastic bag causes the liquid to be unevenly dispersed around the pipe when the bag is left on a hard surface such as a counter. Use of a conformable bag often results in the pipe not being fully submerged in the cleaning solution and therefore not fully cleaned. Additionally, over time the fluid inside the bag will become dirty, which may cause staining of a surface if the bag is perforated or permeable. In order to accommodate a pipe, plastic containers are often large and require more cleaning solution then would otherwise be necessary in order to fully submerge the pipe. Plastic containers are also passive and time consuming. Such prior pipe cleaning methods rely on the cleaning solution to slowly soak into the resin. This process is time consuming, often taking hours, or requiring an overnight soaking to dissolve the resin.

More recently, ultrasonic cleaning of small items has become available. Ultrasonic cleaning devices use high-frequency sound waves to create tiny bubbles that help to remove debris from the surface of an object, such as a pipe. Ultrasonic devices are prohibitively expensive for the average user.

Therefore, improvement is needed in this field.

SUMMARY

In certain aspects, the present disclosure provides unique cleaning devices that can effectively clean an instrument. In accordance with some forms, such devices are configured for cleaning a pipe used for smoking. Accordingly, in one embodiment the present disclosure provides a device for cleaning a pipe, the device comprising a device body defining a cleaning lumen in fluid communication with a blade lumen, a blade positioned in the blade lumen and operable to cause fluid flow between the cleaning lumen and the blade lumen, and a pipe holder positioned within the cleaning lumen, the pipe holder configured to hold a pipe within the cleaning lumen. In certain embodiments, the device comprises a support member positioned between the cleaning lumen and the blade lumen, the support member comprising a plurality of openings to allow fluid flow between the cleaning lumen and the blade lumen. In some forms, the openings are configured to encourage the formation of air bubbles within a cleaning solution flowing through the openings. In certain embodiments, the pipe holder comprises a first arm and a second arm, and wherein the first arm and the second arm extend into a central portion of the cleaning lumen. In some forms, the pipe holder comprises a positioning member configured to position the pipe in a central portion of the cleaning lumen. In certain embodiments, the device is configured to cause fluid flow for a set period of time. In accordance with some forms, the cleaning lumen has a cylindrical shape. Some forms comprise a base member defining the blade lumen, wherein the blade is positioned within the blade lumen, and wherein the cleaning lumen extends from the base member. In some forms, the device comprises a lid configured to seal an external opening to the cleaning lumen, the lid also configured to secure the pipe holder in position.

In another embodiment, the disclosure provides a method for cleaning a pipe, the method comprising positioning a pipe in a device into the cleaning lumen of a device as described herein and activating the blade so as to cause a cleaning solution to flow through and around the pipe. In certain embodiments the method comprises adding a cleaning solution to the cleaning lumen. In some forms, the cleaning solution comprises water, isopropyl alcohol, and/or vinegar, sodium bicarbonate, and/or salt.

Additional embodiments, as well as features and advantages of embodiments of the disclosure will be apparent from the description herein.

DESCRIPTION OF THE SELECTED EMBODIMENTS

Figure 1:
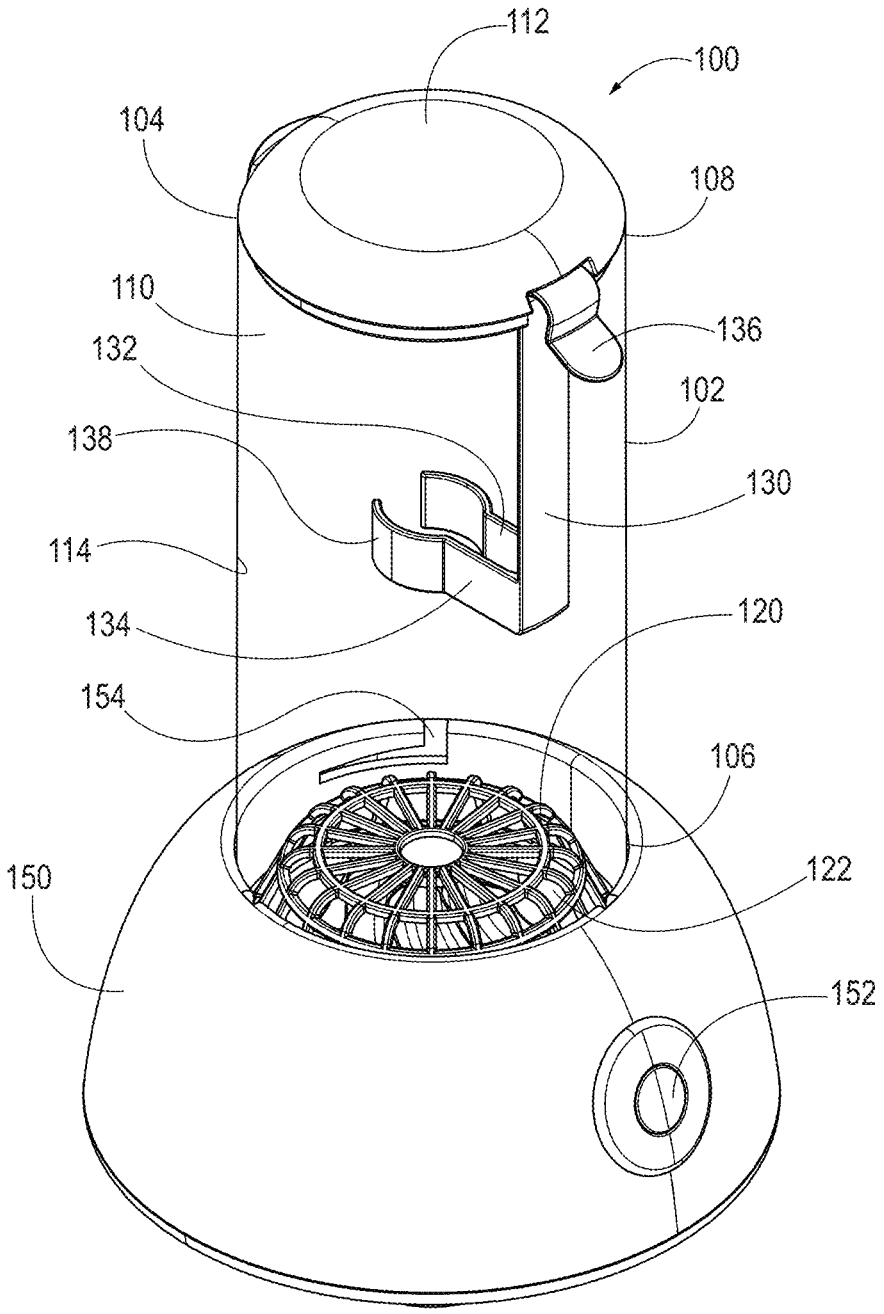
FIG. 1 is a perspective view of a device as disclosed herein.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., may be used in this description with reference to the specific embodiment shown and used for purposes of clarity. It should be recognized that these terms are not meant to be limiting.

The present disclosure relates to systems and methods for cleaning a pipe. More specifically the systems and methods described herein relate to the cleaning of resin buildup on the interior surface of a pipe. In some forms, the resin results from cannabis smoking. The devices and methods disclosed herein may be used with any suitable pipe in need of cleaning. For example, a glass, ceramic, or polymeric pipe may be cleaned as described herein.

A variety of cleaning solutions may be used with the device and methods disclosed herein. A cleaning solution may comprise one or more of the following: water, isopropyl alcohol, and/or vinegar, sodium bicarbonate, and/or salt.

Figure 2:
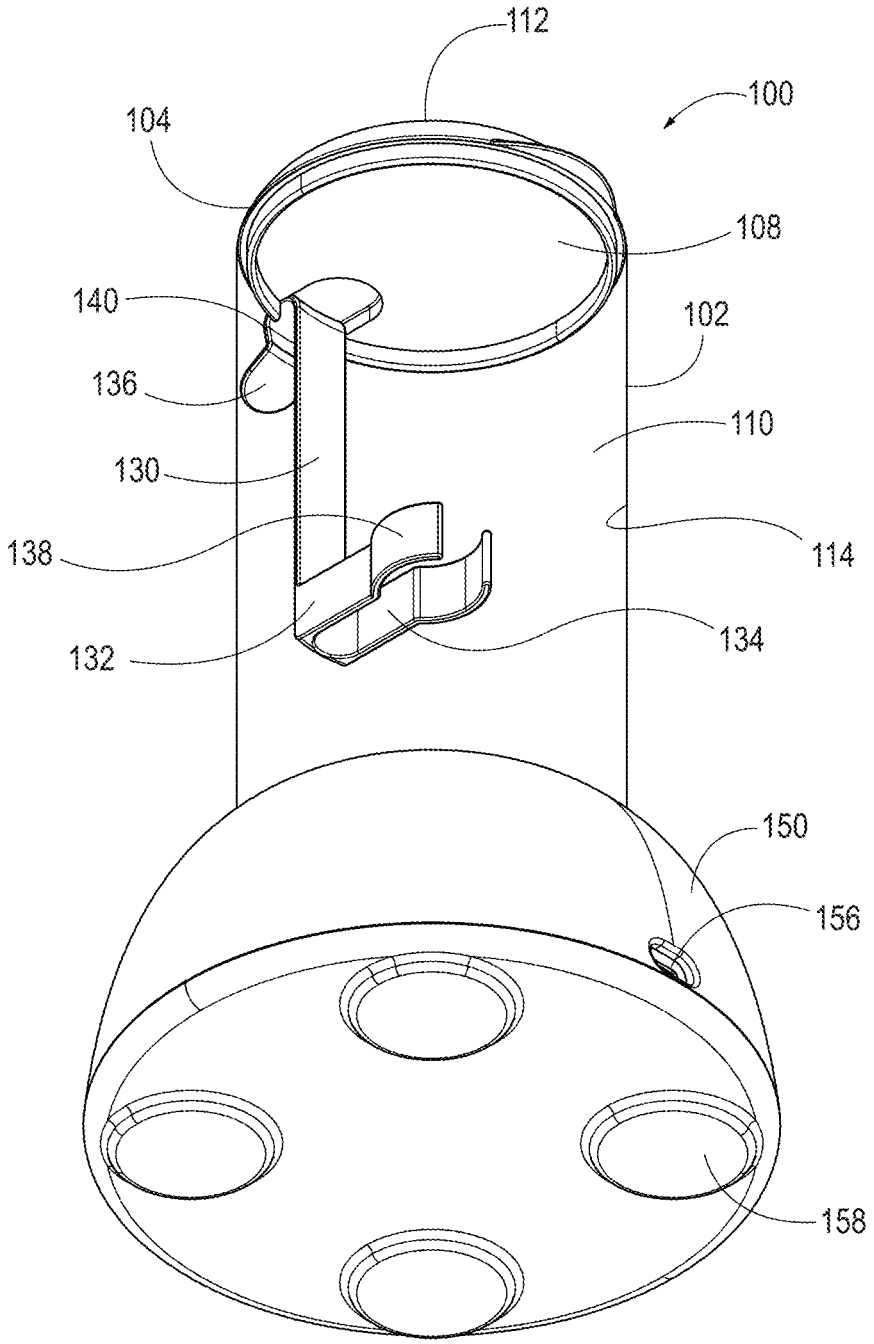
FIG. 2 is a perspective view of a device as disclosed herein.
Figure 3:
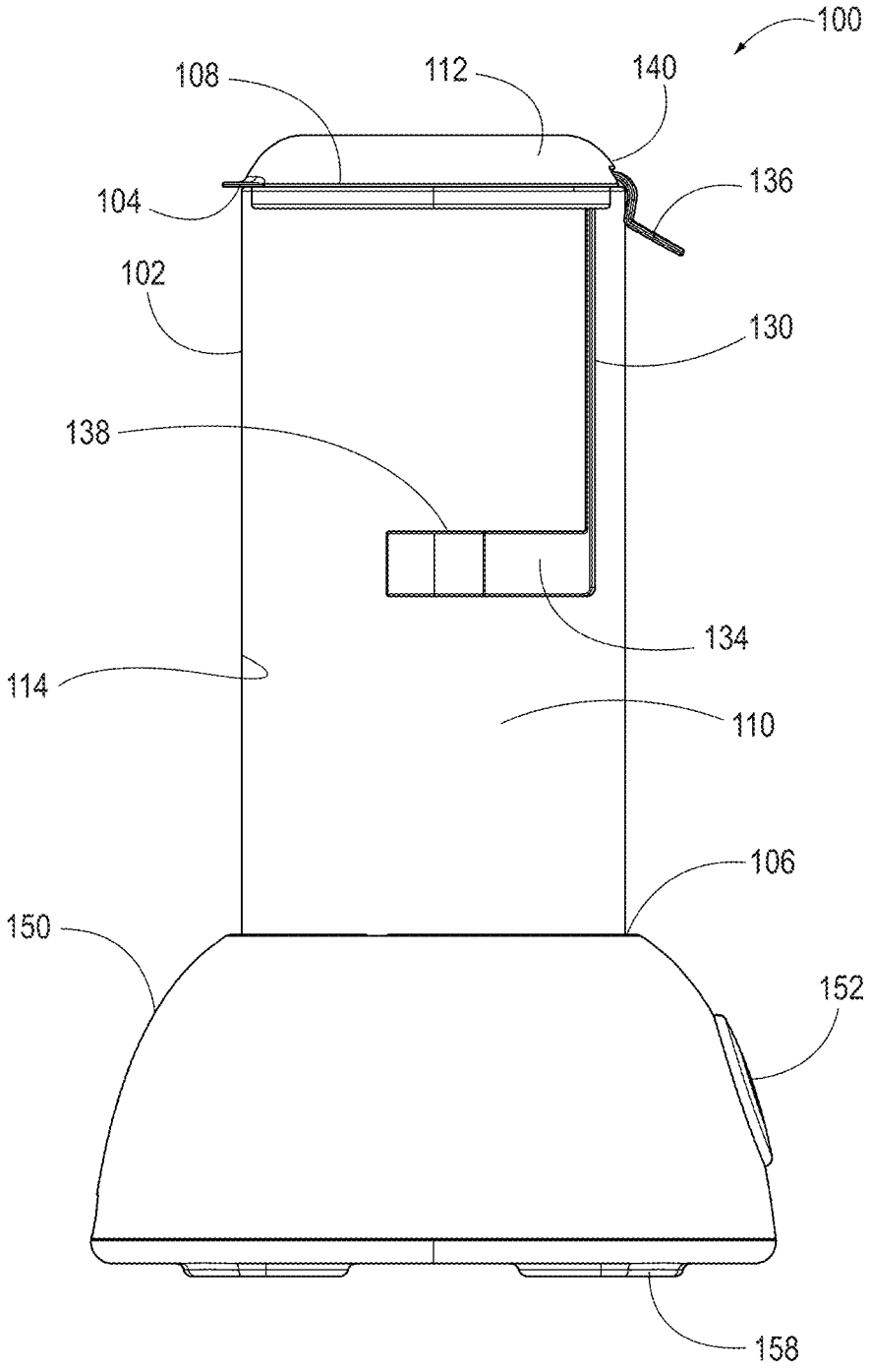
FIG. 3 is a side view of a device as disclosed herein.
Figure 4:
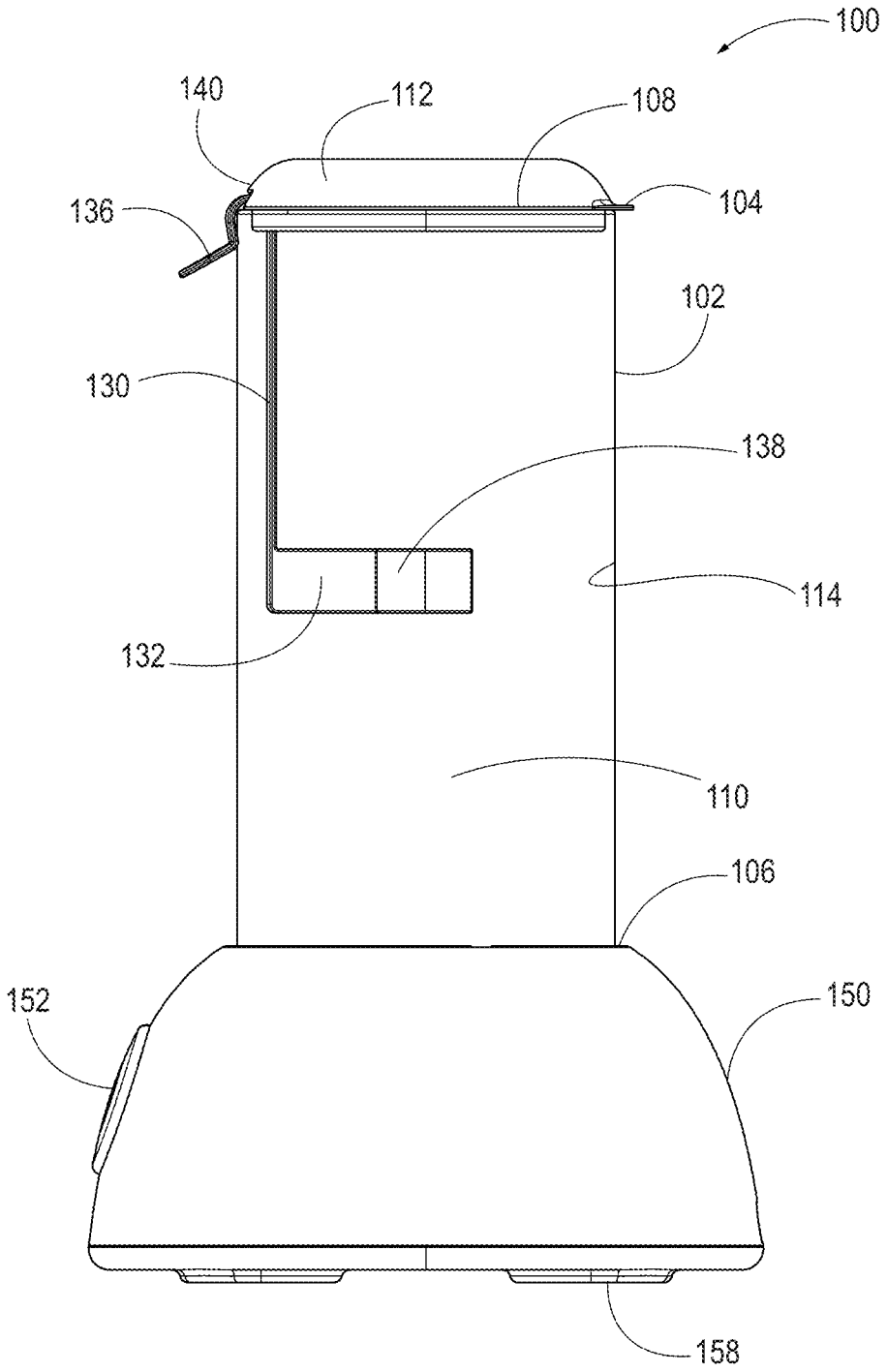
FIG. 4 is a side view of a device as disclosed herein.
Figure 5:
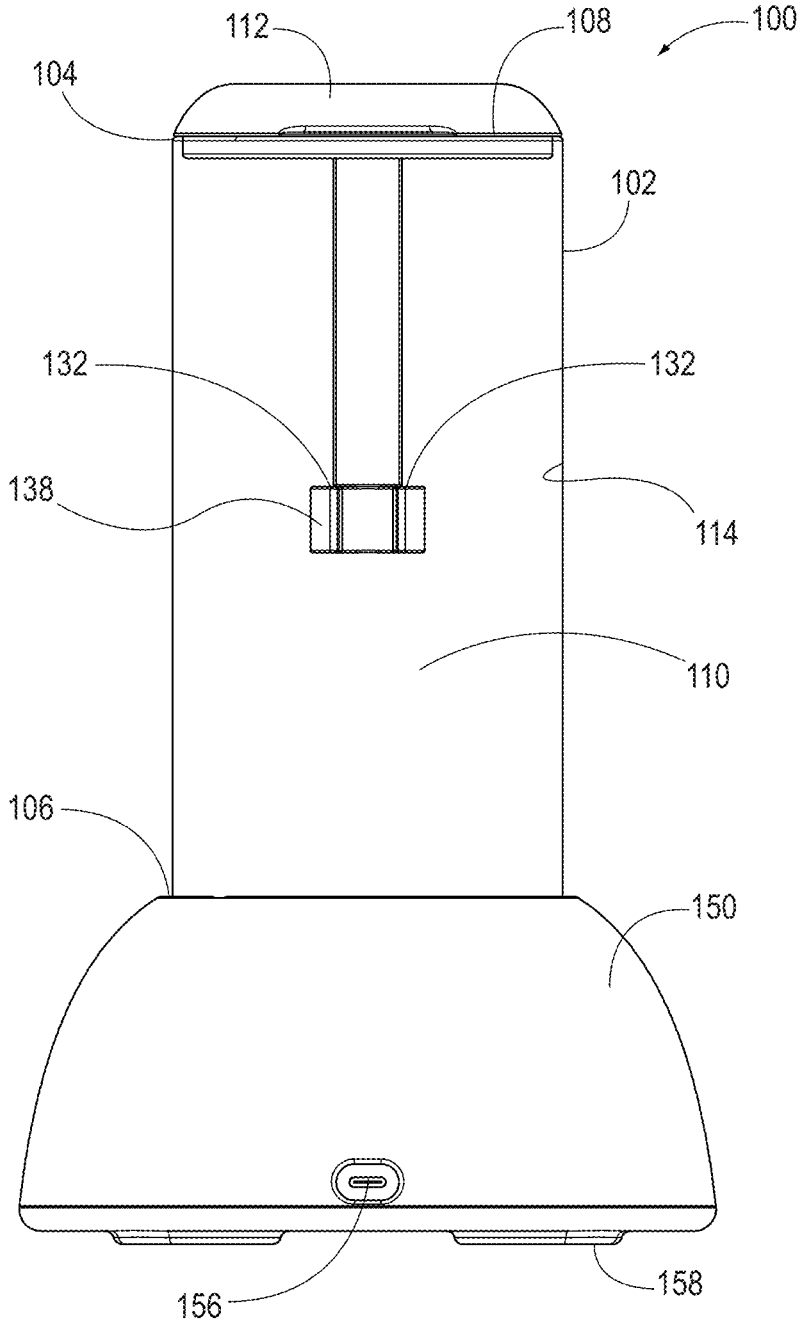
FIG. 5 is a rear view of a device as disclosed herein.
Figure 6:
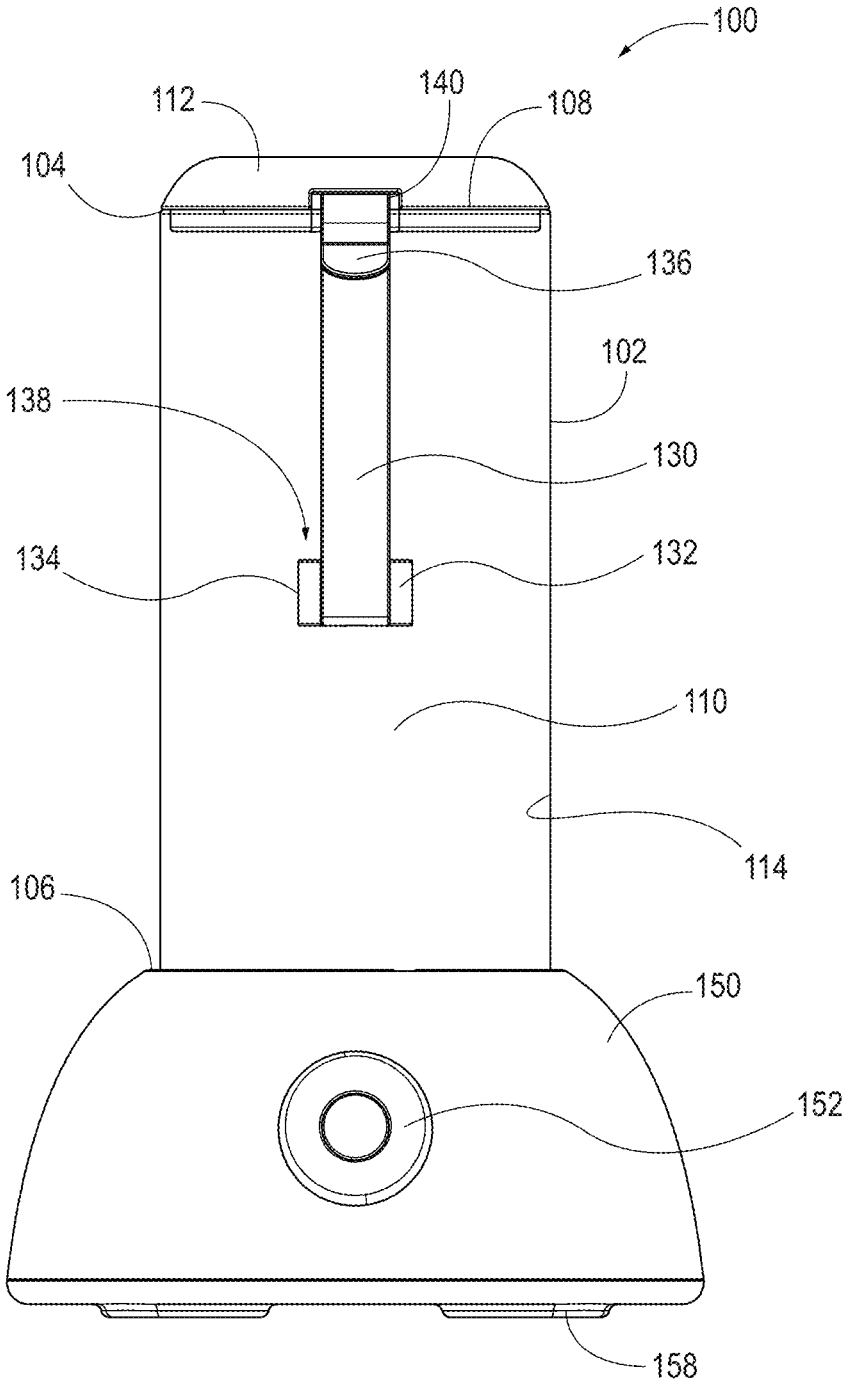
FIG. 6 is a front view of a device as disclosed herein.
Figure 7:
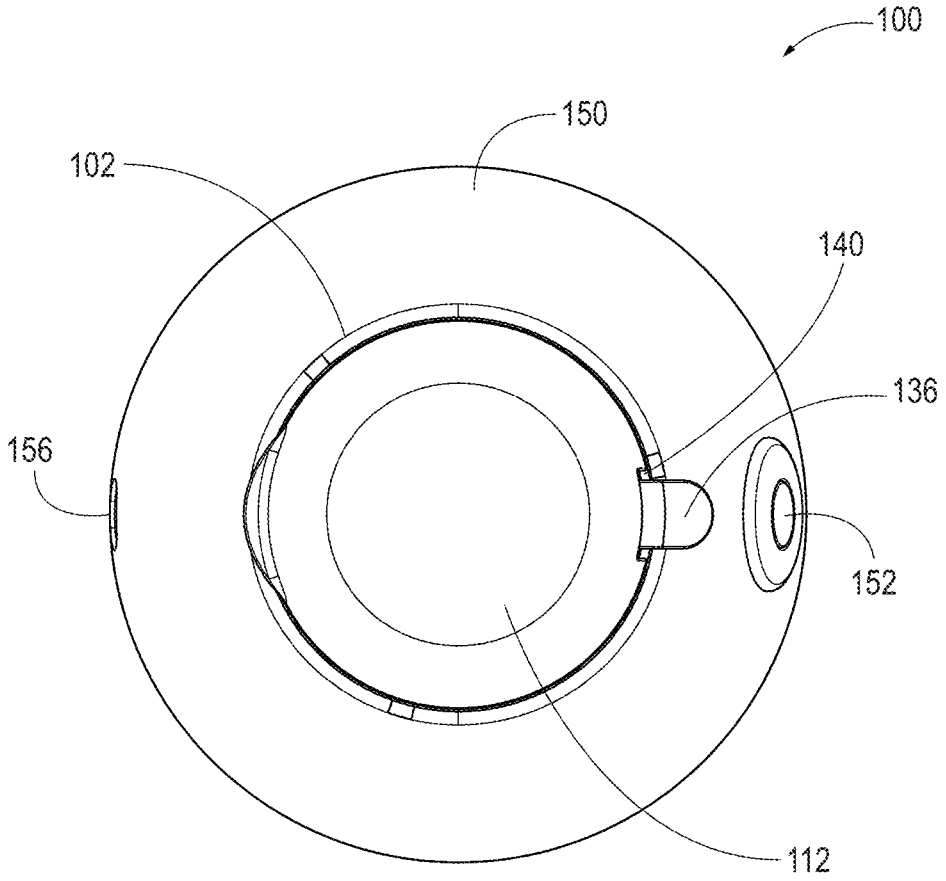
FIG. 7 is a top-down view of a device as disclosed herein.
Figure 8:
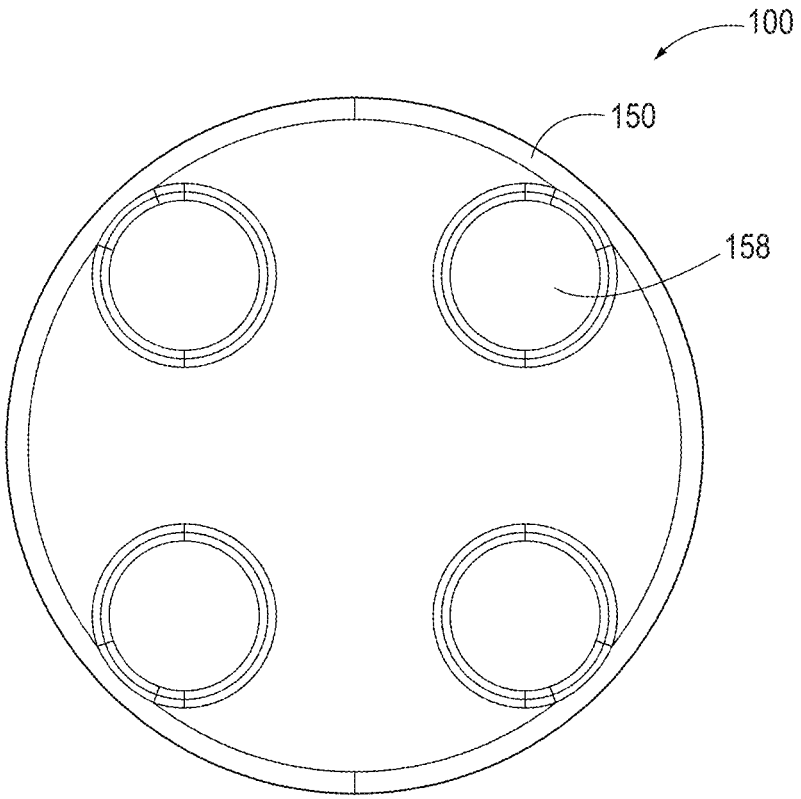
FIG. 8 is a bottom-up view of a device as disclosed herein.

Turning now to the specific embodiment shown in the figures, FIGS. 1 and 2 illustrate perspective views of one embodiment of a pipe cleaning device 100 as disclosed herein. FIGS. 3 and 4 illustrate side views of one embodiment of a pipe cleaning device 100 as disclosed herein. FIGS. 5 and 6 illustrate rear and front views respectively of one embodiment of a pipe cleaning device 100 as disclosed herein. FIG. 7 is a top-down view of one embodiment of a pipe cleaning device 100 as disclosed herein. FIG. 8 is a bottom-up view of one embodiment of a pipe cleaning device 100 as disclosed herein. The illustrated embodiment is provided with transparent sidewalls to more clearly show the internal components of the cleaning lumen. Device 100 comprises cylindrical body 102 extending from top end 104 to bottom end 106 and supported by base 150. Lid 112 seals opening 108 and is removable from body 102. The lid may attach by any suitable means. For example, in some forms the lid is threaded for threadable attachment with opposing threads on the device body. In other embodiments the lid may configured for a secure press or snap fit to the opening. The lid may include a gasket to facilitate liquid tight attachment. Cleaning lumen 110 extends from opening 108 to support member 120 and is defined by inner wall 114. Support member 120 comprises a plurality of openings 122 which allow for fluid passage through the support member. Pipe holder 130 is removably positioned within cleaning lumen 110 and is configured to secure a pipe within cleaning lumen 110. Pipe holder 130 includes first arm 132 and second arm 134 configured to position the pipe in a central location within the cleaning lumen so as to maximize fluid flow around and through the pipe. In the illustrated embodiment, positioning member 138 extends from first and second arms 132/134 to position a pipe in a central portion of cleaning lumen 110. These portions of pipe holder 130 may comprise a resilient material so as to allow insertion and securement of pipes of various shapes and diameters. Pipe holder 130 is also configured to prevent the pipe from moving during cleaning. The illustrated embodiment comprises handle 136 adapted to facilitate removal of the pipe holder from the cleaning lumen 110.

In some forms, switch 152 is positioned on base 150 and may be actuated to perform any suitable function, for example to activate/deactivate the motor, to cycle through various pre-programed cleaning modes, and/or to change the motor speed. In certain embodiments, base 150 and body 102 are configured to releasably lock together. For example, in some forms a locking notch 154 and corresponding ridge 142 are positioned to facilitate attachment of the body to the base. In some forms, lid 112 includes a notch 140 configures to allow handle 136 to extend past lid 112. In this way, pipe holder 130 is supported on body 102 and secured in position when lid 112 is secured. Base 150 may also include a charging port 156 and/or one or more foot pads 158 configures to prevent slippage of the device and mitigate vibrations caused by the motor.

In accordance with some forms, the pipe holder may comprise a basket structure. In this way, the pipe may be positioned within an internal basket lumen and lowered into the cleaning lumen. A basket type holder includes a plurality of openings so as to allow fluid flow through the basket. A basket for use in the present disclosure may comprise any suitable material. In some forms, the basket may be adapted to close at an open end. The basket and/or pipe holder may comprise a conformable material, such as a conformable polymeric material. In certain embodiments the basket and/or pipe holder comprises silicone.

Figure 9:
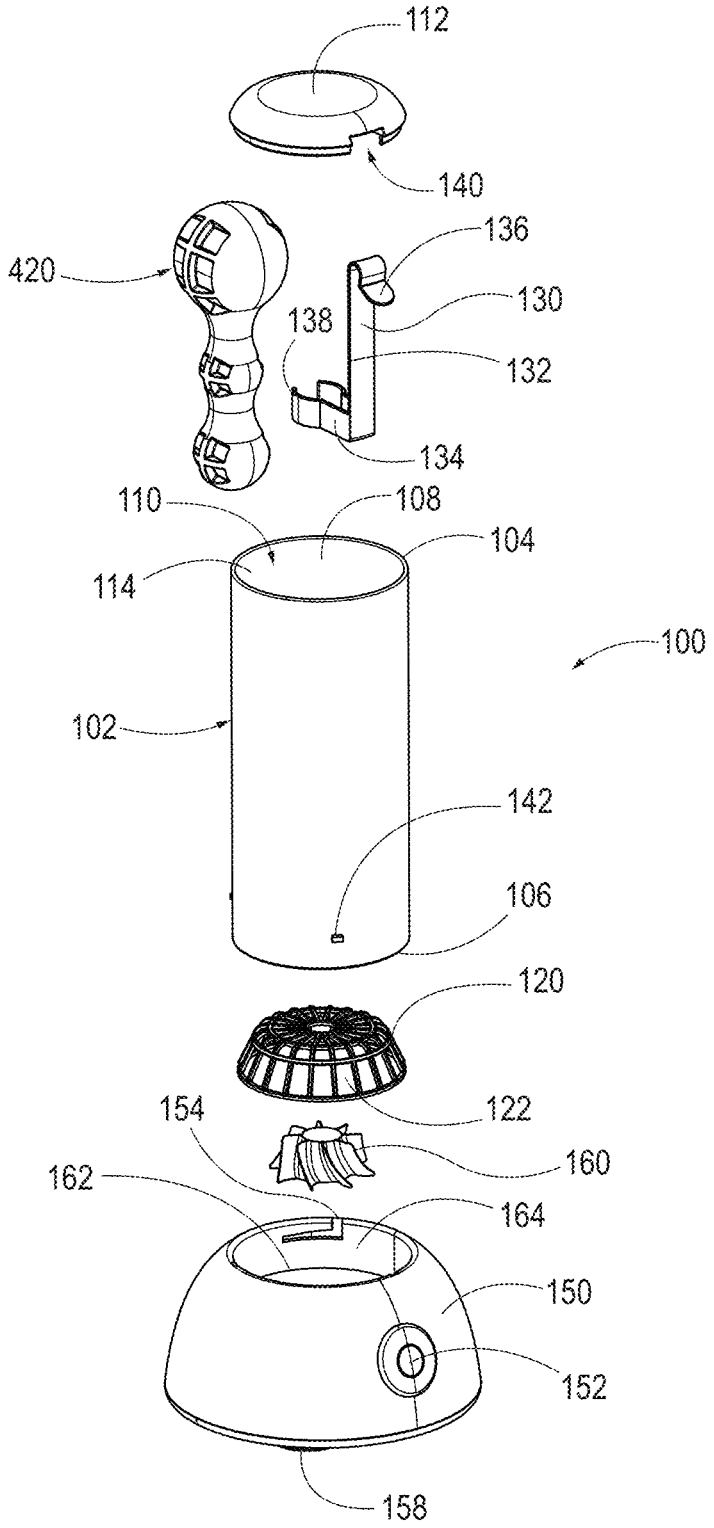
FIG. 9 is an exploded view of a device as disclosed herein.
Figure 10:
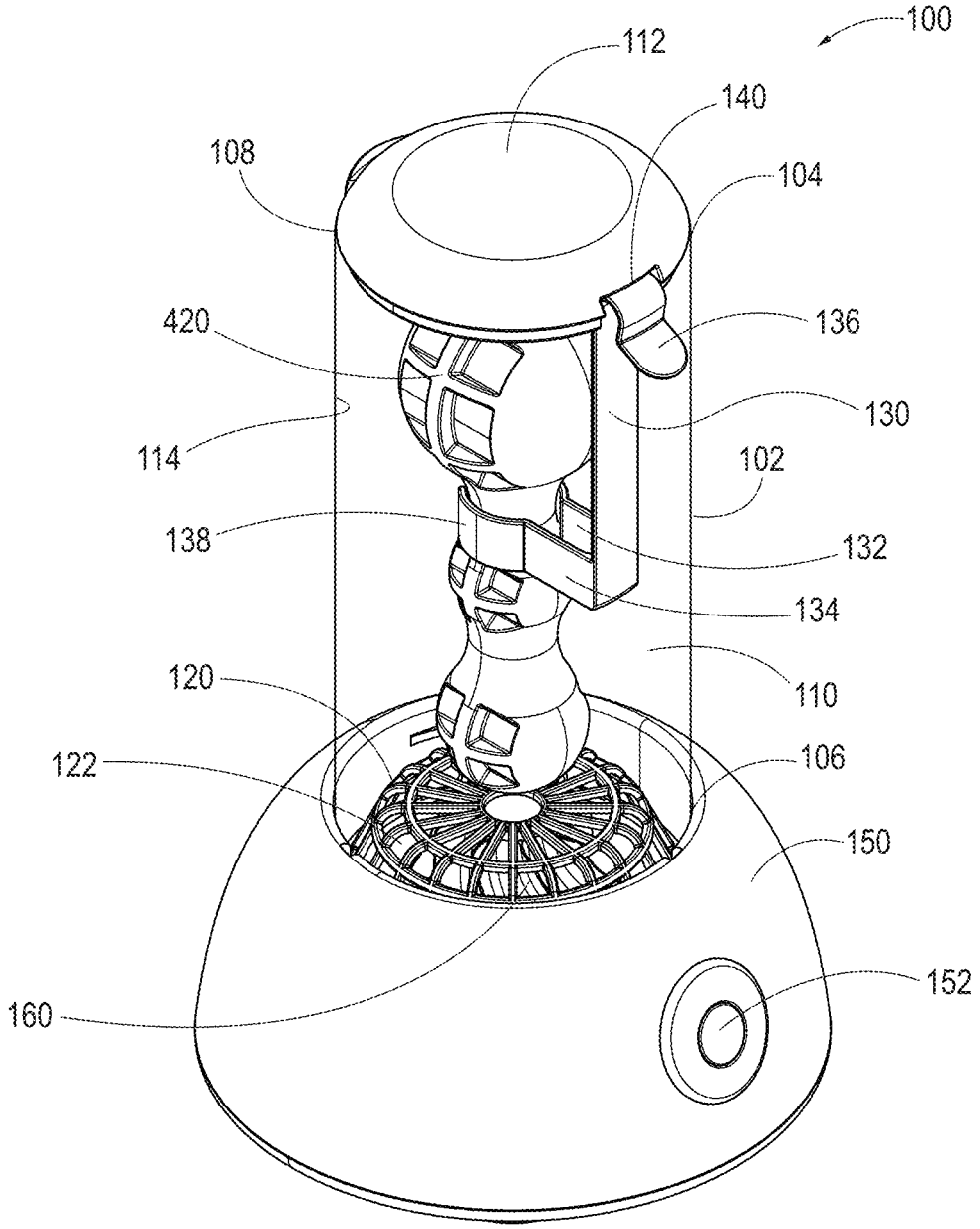
FIG. 10 is a perspective view of a device as disclosed herein.
Figure 11:
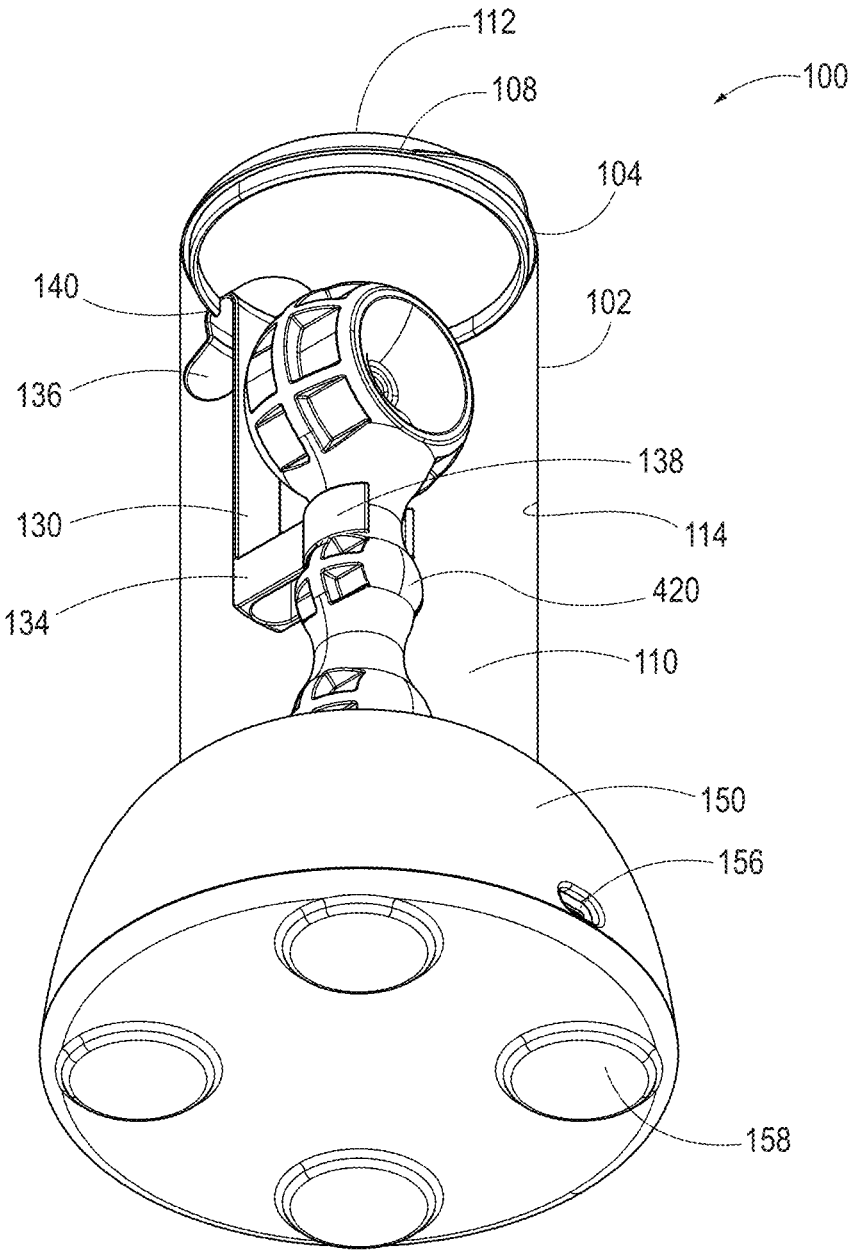
FIG. 11 is a perspective view of a device as disclosed herein.

FIG. 9 provides an exploded view of one embodiment of a device 100 as provided herein. Blade 160 is positioned within blade lumen 162. In the illustrated embodiment blade lumen 162 extends into base 150 and is defined by blade lumen wall 164. In some forms a motor (not pictured) is positioned within base 150 and configured to drive blade 160. Blade 160 is operable to agitate a fluid present in the cleaning lumen and blade lumen so as to create fluid flow though the device. The illustrated embodiment also shows pipe 420. The device is preferably constructed to prevent fluid leakage from the blade lumen to the motor to other components that may be secured within the base. In some forms, the device comprises a battery or may be suitably configured for connection to an external power source. In some forms, one or more of a power source and a motor are housed within the base and protected from fluid exposure FIGS. 10 and 11 are perspective views showing one embodiment of a device 100 as provided herein with a pipe 420 positioned within the cleaning lumen 110. The device may be used for cleaning of any particular pipe or other implement. The pipe illustrated includes a bowl portion having an opening for receiving a substance (e.g. tobacco, cannabis, etc.) to be smoked. The bowl opening is in fluid communication with a mouth opening with an elongate passage therebetween. The pipe may comprise any suitable material, such as glass, ceramic, silicone, wood, metal, etc. When positioned in the cleaning lumen, the pipe may be positioned with the end having the bowl opening facing up (e.g. towards the lid) or down. In this way, fluid cleaning solution is encouraged to flow through the pipe, including through the bowl portion, elongate passage, and mouth opening.

In use, a cleaning solution is introduced into the device such that the blade lumen and at least part of the cleaning lumen is filled. A pipe is placed within the cleaning lumen, preferably secured with a pipe holder and at least partially submerged into the cleaning solution. In certain embodiments, the lid is securely attached to the top portion to create fluid tight seal. The motor is engaged causing the blade to rotationally agitate the cleaning solution which is driven through the openings in the support member if present. In this way, the cleaning fluid is propelled around the inner lumen(s) of the device causing resin on the pipe to be dislodged and removed from the device. In some forms, the openings are configured to encourage formation of air bubbles within the cleaning solution. Thus, the pipe is exposed to a wash of cleaning solution flowing through the basket and/or pipe holder. The device may be configured to operate for a set time, for example ten to fifteen minutes. Alternatively, the device may be configured to remain activated until deactivated by the user.

The device is shown having a generally cylindrical shape. It is within the scope of the invention to provide an active cleaning device of any suitable shape. A cylindrical inner profile is advantageous so as to facilitate vortex fluid flow at least in the cleaning lumen. In some forms, the device comprises an elongate body facilitating vertical positioning of a pipe within the basket.

The present disclosure also includes methods of cleaning resin from a pipe. Such methods may comprise the step of inserting a pipe into a device as disclosed herein and activating the motor to cause flow of the cleaning solution through the pipe.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

The invention claimed is:

1. A method for cleaning a pipe used for smoking, the method comprising:

positioning the pipe into a pipe holder;

positioning the pipe holder into a cleaning lumen of a device, the device comprising:

a device body defining a sealable chamber comprising the cleaning lumen and a blade lumen in fluid communication with the cleaning lumen, wherein the blade lumen is separated from the cleaning lumen by a support member having a plurality of openings;

a blade positioned in the blade lumen and operable to cause fluid flow between the cleaning lumen and the blade lumen; and cleaning the pipe to remove a smoked substance by activating the blade so as to cause a cleaning solution contained within the sealable chamber to flow through the plurality of openings between the cleaning lumen and the blade lumen and through and around the pipe.

2. The method of claim 1, further comprising:

adding the cleaning solution to the sealable chamber cleaning lumen.

3. The method of claim 1, further comprising:

removing the pipe holder from the cleaning lumen.

4. The method of claim 2, wherein the cleaning solution comprises: water, isopropyl alcohol, vinegar, sodium bicarbonate, salt or combinations thereof.

* * * * *